US008092157B2

(12) United States Patent
McCaffrey

(10) Patent No.: US 8,092,157 B2
(45) Date of Patent: Jan. 10, 2012

(54) VARIABLE TURBINE VANE ACTUATION MECHANISM HAVING A BUMPER RING

(75) Inventor: Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 1055 days.

(21) Appl. No.: 12/002,806

(22) Filed: Dec. 19, 2007

(65) Prior Publication Data

US 2009/0162192 A1 Jun. 25, 2009

(51) Int. Cl.
*F01D 17/16* (2006.01)

(52) U.S. Cl. ..... 415/160

(58) Field of Classification Search ..... 415/159, 415/160, 162

See application file for complete search history.

(56) References Cited

U.S. PATENT DOCUMENTS 4,812,106 A * 3/1989 Purgavie ..... 415/160
4,834,613 A 5/1989 Hansen et al.
4,925,364 A * 5/1990 Das ..... 415/162
4,979,874 A 12/1990 Myers
5,035,573 A 7/1991 Tseng et al.
5,096,375 A 3/1992 Ciokailo
5,116,158 A 5/1992 Carruthers et al.
5,224,824 A 7/1993 Eng
5,387,080 A * 2/1995 Bouhennicha et al. ..... 415/162
5,700,129 A * 12/1997 Kocian ..... 415/160
6,763,654 B2 7/2004 Orlando et al.
6,769,868 B2 8/2004 Harrold
6,884,025 B2 * 4/2005 Pickens et al. ..... 415/160
7,198,454 B2 * 4/2007 Evans ..... 415/159
7,244,098 B2 * 7/2007 Bromann ..... 415/160
7,677,866 B2 * 3/2010 Bromann ..... 415/160
2006/0013683 A1 1/2006 Martindale

* cited by examiner

*Primary Examiner* — Richard Edgar
(74) *Attorney, Agent, or Firm* — Kinney & Lange, P.A.

(57) ABSTRACT

A variable vane actuation assembly for gas turbine engines having rotatable stator vanes comprises an engine casing, a unison ring, a bumper ring, a radial spline connection and a plurality of bumper shims. The engine casing is configured to encase the rotatable stator vanes. The unison ring is disposed concentrically with the engine casing. The bumper ring is disposed concentrically between the engine casing and the unison ring. The radial spline connection extends from the engine casing and joins with the bumper ring to permit the bumper ring to float radially with respect to the engine casing, but prevent the bumper ring from rotating circumferentially with respect to the engine-casing. The plurality of bumper shims are positioned between the unison ring and the bumper ring to limit deformation of the unison ring.

22 Claims, 5 Drawing Sheets

VARIABLE TURBINE VANE ACTUATION MECHANISM HAVING A BUMPER RING

BACKGROUND

The present invention is related to gas turbine engines, and in particular to variable stator vanes and variable stator vane actuation mechanisms.

Gas turbine engines operate by combusting fuel in compressed air to create heated gases with increased pressure and density. The heated gases are used to rotate turbines within the engine that are used to produce thrust or generate electricity. For example, in a propulsion engine, the heated gases are ultimately forced through an exhaust nozzle at a velocity higher than which inlet air is received into the engine to produce thrust for driving an aircraft. The heated gases are also used to rotate turbines within the engine that are used to drive a compressor that generates compressed air necessary to sustain the combustion process.

The compressor and turbine sections of a gas turbine engine typically comprise a series of rotor blade and stator vane stages, with the rotating blades pushing air past the stationary vanes. In general, stators redirect the trajectory of the air coming off the rotors for flow into the next stage. In the compressor, stators convert kinetic energy of moving air into pressure, while, in the turbine, stators accelerate pressurized air to extract kinetic energy. Gas turbine efficiency is, therefore, closely linked to the ability of a gas turbine engine to efficiently direct airflow within the compressor and turbine sections of the engine. Airflow through the compressor and turbine sections differs at various operating conditions of the engine, with more airflow being required at higher output levels. Variable stator vanes have been used to advantageously control the incidence of airflow onto rotor blades of subsequent compressor and turbine stages under different operating conditions.

Variable stator vanes are typically radially arranged between stationary outer and inner diameter shrouds, which permit the vanes to rotate about trunnion posts at their innermost and outermost ends to vary the pitch of the vane. Typically, the outermost trunnion posts include crank arms that are connected to a unison ring, which is rotated by an actuator to rotate the vanes in unison. The outermost trunnions extend through the outer shroud, typically an engine case, such that the unison ring is positioned outside the engine case, while the vane airfoils are within the engine case, in the stream of the heated gases flowing through the engine. The engine case comprises a rigid structural component necessary for containing the high operational pressures of the engine, while the unison ring only requires enough strength to transmit torque to the crank arms. As such, the unison ring has a tendency to deform when acted upon by the actuator as the unison ring is suspended over the engine case by the crank arms. Typically, bumpers are positioned between the unison ring and the engine case to increase the rigidity of the unison ring. The bumpers link the unison ring to the engine case such that the engine case lends its stiffness to the unison ring, thus retaining the centricity of the unison ring. However, because the unison ring is disposed outside of the engine case and the flow of the heated gases, the engine casing is subject to much higher temperatures than the unison ring, especially when used with variable turbine vanes. As such, the engine case undergoes greater thermal expansion than the unison ring, resulting in a greater increase in the circumference of the engine case. Thus, there is a tendency for the engine case to grow into the unison ring, causing binding with the bumpers that interferes with precise actuation of the variable vanes. There is, therefore, a need for a variable vane actuation mechanism suitable for use in high temperature differential environments such as turbines.

SUMMARY

The present invention is directed toward a variable vane actuation assembly for a gas turbine engine having a plurality of rotatable stator vanes. The variable vane actuation assembly comprises an engine casing, a unison ring, a bumper ring, a radial spline connection and a plurality of bumper shims. The engine casing is configured to encase the plurality of rotatable stator vanes. The unison ring is disposed concentrically with the engine casing. The bumper ring is disposed concentrically between the engine casing and the unison ring. The radial spline connection extends from the engine casing and joins with the bumper ring to permit the bumper ring to float radially with respect to the engine casing, but prevent the bumper ring from rotating circumferentially with respect to the engine casing. The plurality of bumper shims are positioned between the unison ring and the bumper ring to limit deformation of the unison ring.

DETAILED DESCRIPTION

Figure 1:
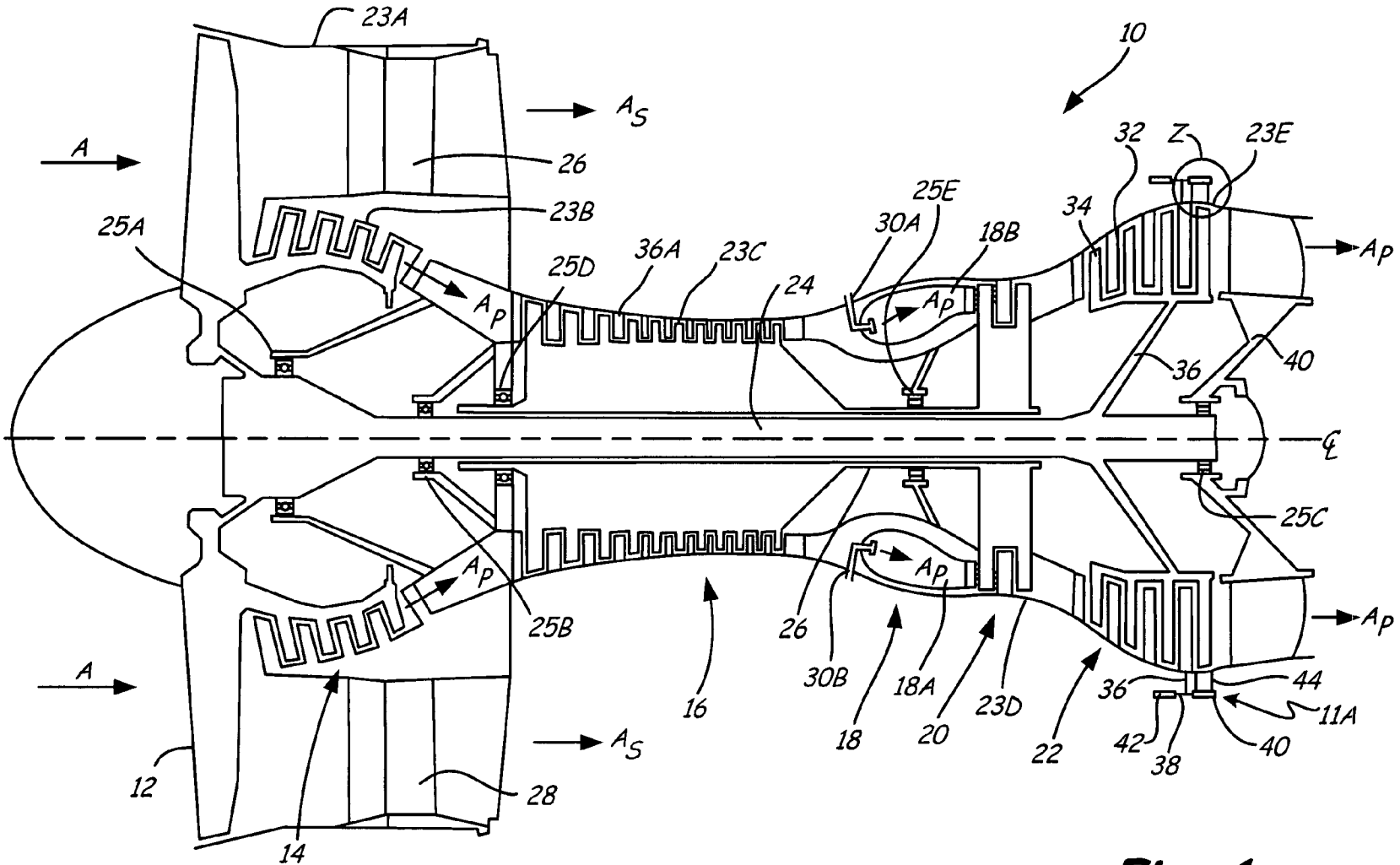
FIG. 1 shows a schematic cross sectional view of a gas turbine engine in which a variable vane actuation mechanism of the present invention is used.

FIG. 1 shows a schematic cross section of gas turbine engine 10 in which variable vane actuation mechanism 11A of the present invention is used. In the embodiment shown, gas turbine engine 10 comprises a dual-spool, high bypass ratio turbofan engine having a variable vane turbine section incorporating actuation mechanism 11A. In other embodiments, gas turbine engine 10 comprises other types of gas turbine engines used for aircraft propulsion or power generation, or other similar systems incorporating variable stator vanes. Although, the advantages of actuation mechanism 11A are particularly well suited for turbine sections having variable vanes, the invention is readily applicable to compressor sections having variable vanes.

Gas turbine engine 10, of which the operational principles are well known in the art, comprises fan 12, low pressure compressor (LPC) 14, high pressure compressor (HPC) 16, combustor section 18, high pressure turbine (HPT) 20 and low pressure turbine (LPT) 22, which are each concentrically disposed around axial engine centerline CL. Fan 12, LPC 14, HPC 16, HPT 20, LPT 22 and other engine components are enclosed at their outer diameters within various engine casings, including fan case 23A, LPC case 23B, HPC case 23C, HPT case 23D and LPT case 23E. Fan 12 and LPC 14 are connected to LPT 22 through shaft 24, which is supported by ball bearing 25A and roller bearing 25B toward its forward end, and ball bearing 25C toward its aft end. Together, fan 12, LPC 14, LPT 22 and shaft 24 comprise the low pressure spool. HPC 16 is connected to HPT 20 through shaft 26, which is supported within engine 10 at ball bearing 25D and roller bearing 25E. Together, HPC 16, HPT 20 and shaft 26 comprise the high pressure spool.

Inlet air A enters engine 10 whereby it is divided into streams of primary air $A_P$ and secondary air $A_S$ after passing through fan 12. Fan 12 is rotated by low pressure turbine 22 through shaft 24 to accelerate secondary air $A_S$ (also known as bypass air) through exit guide vanes 28, thereby producing a significant portion of the thrust output of engine 10. Primary air $A_P$ (also known as gas path air) is directed first into low pressure compressor 14 and then into high pressure compressor 16. LPC 14 and HPC 16 work together to incrementally increase the pressure and temperature of primary air $A_P$. HPC 16 is rotated by HPT 20 through shaft 26 to provide compressed air to combustor section 18. The compressed air is delivered to combustor 18, along with fuel from injectors 30A and 30B, such that a combustion process can be carried out to produce high energy gases necessary to turn high pressure turbine 20 and low pressure turbine 22. Primary air $A_P$ continues through gas turbine engine 10 whereby it is typically passed through an exhaust nozzle to further produce thrust.

Flow of primary air $A_P$ through engine 10 is enhanced through the use of variable stator vanes at various locations within the compressor and turbine sections. In particular, LPT 22 includes variable stator vanes 32, which are disposed axially between blades 34. The pitch of variable vanes 32 is adjusted by actuation mechanism 11A. Variable stator vanes 32 include outer trunnions 36, which extend through LPT case 23E and connect with crank arms 38. Actuation mechanism 11A includes unison ring 40, actuator 42 and bumper ring 44. Each crank arm 38 is connected to unison ring 40, with one or two master crank arms selected from crank arms 38 also being connected to actuator 42. When pushed or pulled by actuator 42, the master crank arms cause circumferential rotation of unison ring 40 about centerline CL. Unison ring 40 correspondingly pushes or pulls on the remaining crank arms 38 to cause trunnions 36 and vanes 32 to rotate about their radial axes, which extend perpendicular to centerline CL. When actuated, vanes 32 rotate in unison to adjust the flow of primary air $A_P$ through engine 10 for different operating conditions. For example, when engine 10 undergoes transient loading such as a during take-off operation, the mass flow of primary air $A_P$ pushed through LPT 22 increases as engine 10 goes from idle to high-throttle operation. As such, the pitch of vanes 32 may be continually altered to, among other things, improve airflow and prevent stall.

LPT case 23E, being a vital structural component of engine 10, comprises a sturdy, rigid structure capable of receiving substantial axial and radial loading imparted during operation of engine 10. Unison ring 40, however, comprises a thin annular sleeve that primarily functions to transmit torque loads from the master crank arms to crank arms 38 and is therefore as light as possible to reduce engine weight. As with LPT case 23E, unison ring 40 is typically split into two-pieces to provide access to vanes 32 and blades 34. As such, maintaining the circularity or centricity of unison ring 40 when torque is applied from actuator 42 during transient loading conditions of engine 10 is inhibited by the function and construction of unison ring 40. LPT 22 includes-actuation mechanism 11A of the present invention to prevent distortion and deformation of unison ring 40 during operation of engine 10, particularly during transient loading operation. Thermal gradients produced within engine 10 during transient loading induce varying thermal expansions of unison ring 40 and LPT case 23E. Bumper ring 44 expands radially with unison ring 40, without binding against LPT case 23E, to provide a rigid frame that unison ring 40 engages for support.

Figure 2:
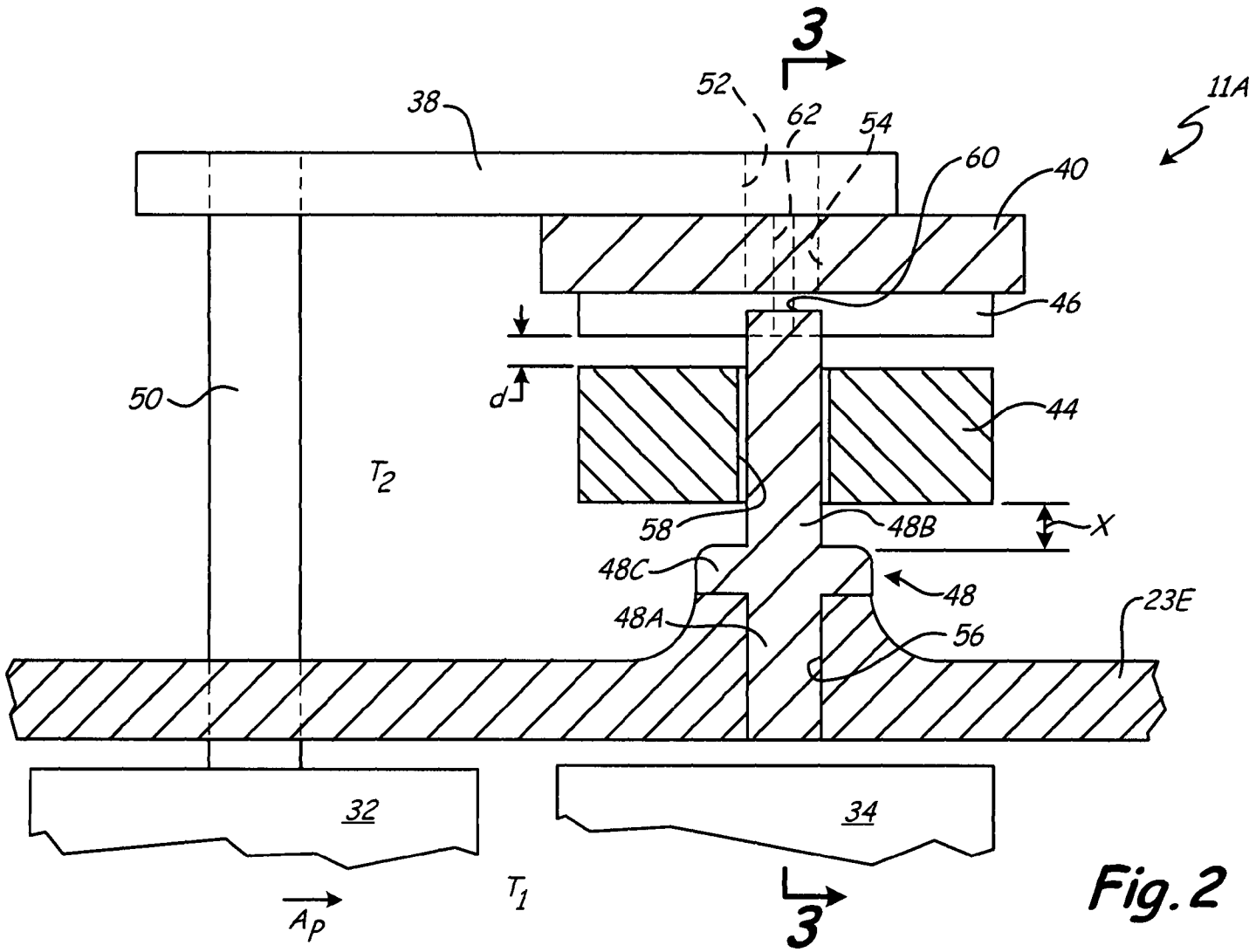
FIG. 2 shows an axial cross sectional view of a first embodiment of the variable vane actuation mechanism of the present invention in which a bumper ring is positioned outside of an engine casing.
Figure 3:
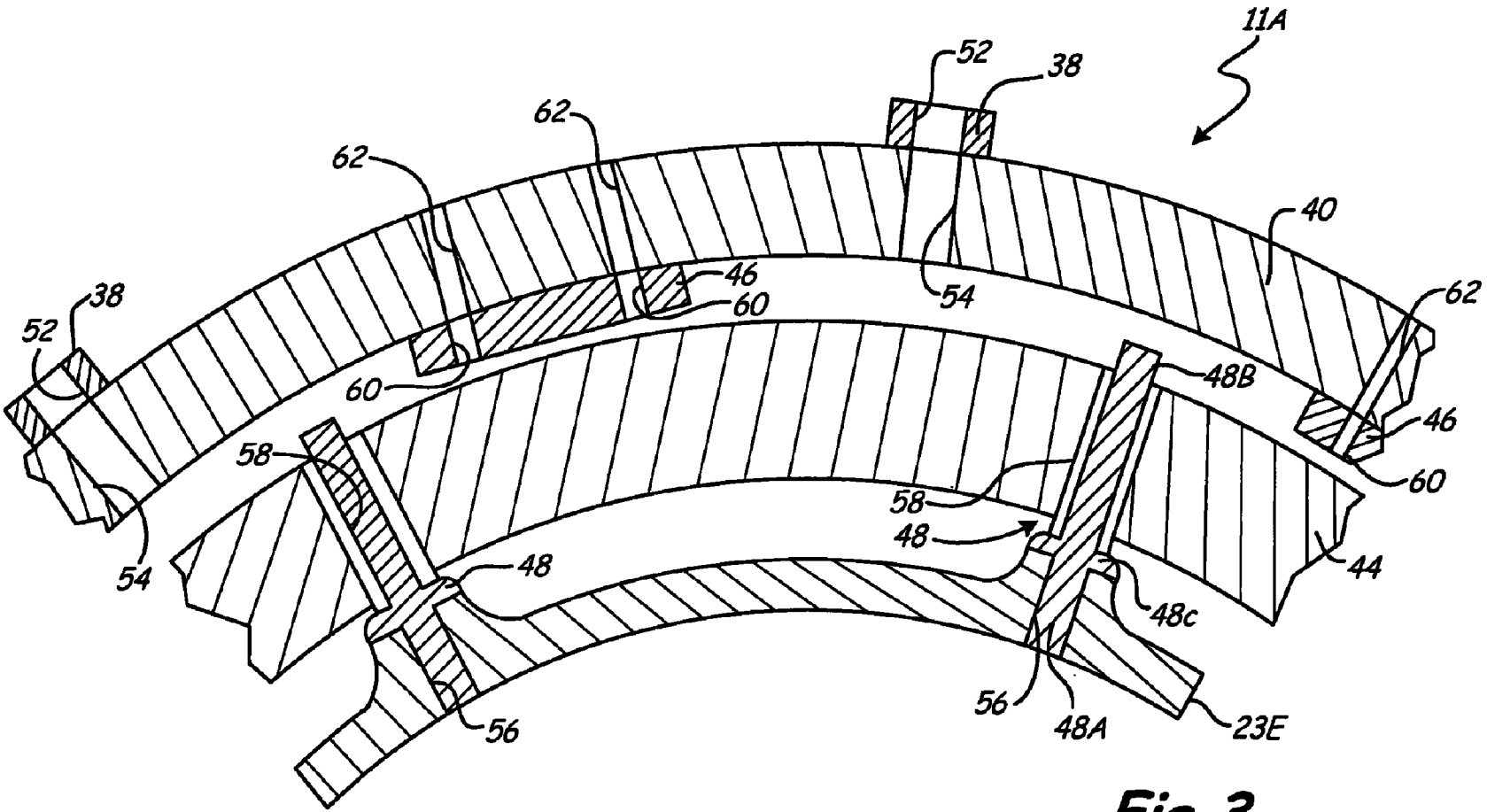
FIG. 3 shows a radial cross sectional view of the variable vane actuation mechanism of FIG. 2.

FIG. 2 shows an axial cross sectional view of variable vane actuation mechanism 11A of the present invention, as shown at callout Z in FIG. 1. FIG. 3, which is discussed concurrently with FIG. 2, shows a radial cross sectional view taken at section 3-3 of FIG. 2. Variable stator vanes 32 and rotor blades 34 are disposed radially within LPT case 23E within engine 10. Rotor blades 34 typically include various sealing systems such as knife edge seals, but such systems have been omitted from FIG. 2 for simplicity. Variable vane actuation mechanism 11A of the present invention includes a plurality of crank arms 38, unison ring 40, bumper ring 44, a plurality of bumper shims 46 and a plurality of radial pins 48, which are all disposed concentrically about LPT case 23E.

In the embodiment of the present invention shown in FIGS. 2 and 3, the outer diameter ends of variable vanes 32 include trunnions 50 that extend through engine case 23E such that vanes 32 are rotatable along their radial axes within engine 10 to control the incidence of primary air $A_P$ onto blades 34. The outer diameter ends of trunnions 50 are typically connected to upstream ends of crank arms 38. Downstream ends of crank arms 38 connect with unison ring 40. Crank arms 38 comprise generally rectangular levers that rigidly connect with trunnions 50 and rotatably connect with unison ring 40 using any method as is known in the art. For example, crank arms 38 include bore 52 and unison ring 40 includes bores 54, which align to accept threaded fasteners or pin connectors to maintain a connection that permits crank arm 38 to pivot on unison ring 40. Unison ring 40 is connected to actuator 42 (FIG. 1) through a master crank arm (not shown) such that rotation of unison ring 40 about centerline CL of engine 10 can be effected. Unison ring 40 then acts upon crank arms 38 to cause radial rotation of outer trunnions 50 and vanes 32. As such, the pitch of vanes 32 can be adjusted to permit continually varied flow of primary air $A_P$ through vanes as is needed during transient loading operations of engine 10.

Transient loading of engine 10 results in a rapid increase of the temperatures produced within engine 10 by combustor 18 (FIG. 1). A typical transient loading scenario for a thrust producing gas turbine engine involves starting at idle and ramping up in a matter of seconds to an extremely high output such as is necessary to perform a take-off operation. The temperature $T_1$ inside LPT case 23E rises from approximately 500° F. (~260° C.) to approximately 1000° F. (~538° C.) during transition from idle operation to take-off operation. Because the outside of LPT case 23E is actively cooled with cooler compressor air, the temperature $T_2$ outside LPT case 23E rises from approximately 100° F. (~380° C.) to approximately 500° F. (~260° C.) during the same transition. Thus, LPT case 23E, which is adjacent the high temperatures within LPT 22 thermally expands more than unison ring 40. The temperature disparity produces different thermal growth characteristics of LPT case 23E and unison ring 40. Particularly, the diameter of LPT case 23E increases significantly more than the diameter of unison ring 40, as LPT case 23E undergoes a much larger increase in temperature than unison ring 40. Furthermore, the pressurization of primary air $A_P$ from LPC 14 and HPC 16 causes an additional outward radial expansion tendency of LPT case 23E due to the pressure load. The disparity in the temperature increases between unison ring 40 and LPT case 23E cannot easily be accommodated by selecting materials as is done in compressor sections having variable vanes, as materials with much higher temperature limitations are needed.

For example, in a compressor section, the temperature on the outside of the compressor case is approximately 100° F. (~38° C.) at idle, while the temperature inside the compressor case is approximately 150° F. (~67° C.). These temperatures rise to approximately 200° F. (~93° C.) outside, and approximately 500° F. (~260° C.) inside the compressor case during take-off operations. Such temperature differentials can be accounted for by matching material types for the compressor case and the unison ring. For example, the compressor casing can be comprised of a titanium-based alloy that has a low coefficient of thermal expansion. Thus, the relatively low temperatures generated within the compressor results in low thermal expansion of the compressor casing. The unison ring, which is subjected to lower temperature than the compressor casing, can then be made of a nickel-based alloy having a higher coefficient of thermal expansion such that the unison ring and the compressor case expand at generally the same rate, preventing binding of bumper shims with the compressor case. Nickel-based alloys have coefficients of thermal expansion approximately thirty to forty percent higher than titanium-based alloys. Thus, the compressor case and the unison ring expand approximately the same amount such that the rigidity provided by the crank arms is sufficient to maintain the centricity of the unison ring. Additionally, the pitch of variable compressor vanes is adjusted up to approximately twenty degrees during operation of the engine. Thus, small variations in pitch actuation of the variable vanes are within acceptable tolerance limits, making small variations in the centricity of the unison ring acceptable. The lower temperatures generated in the compressor make it-possible to use alloys having low temperature limitations such that expansion effects can be compensated.

Turbine casings, however, cannot be made of materials having low coefficients of thermal expansion as they must also be made of materials having high temperature limitations, such as nickel based alloys, to survive the temperatures generated in turbine sections. Thus, it is difficult to produce unison ring 40 from a material that will expand at the lower temperature it is exposed to at the same rate as LPT case 23E, which is exposed to higher temperatures. Furthermore, the pitch of variable turbine vanes is adjusted only approximately 5 degrees during operation of the engine. Thus, small variations in pitch actuation of the variable vanes are typically not within acceptable tolerance limits, making small variations in the centricity of the unison ring undesirable. In order to prevent what would conventionally result in binding of the engine casing with unison ring bumper shims, the present invention provides bumper ring 44 between engine case 23E and unison ring 40 to prevent such binding of bumper shims 46.

Bumper ring 44 is disposed concentrically between unison ring 40 and LPT case 23E. Bumper ring 44 is configured to float on radial pins 48 about LPT case 23E, such that LPT case 23E is free to expand in the radial direction from the heat of primary air $A_P$ without influencing bumper ring 44. Radial pins 48 include radially inner base portions 48A that extend into bores 56 of LPT case 23E to prevent movement of pins 48 with respect to LPT case 23E. For example, base portions 48A are force fit or threaded into bores 56. Radial pins 48 also include radially outer spline portions 48B that extend into bores 58 of bumper ring 44. Bores 58 are sized to permit bumper ring 44 to freely float, or slide, upon spline portions 48B during all operating conditions of engine 10. For example, bores 58 are sized to permit expansion and contraction of bumper ring 44 without binding of bores 58 on pins 48. Pins 48 also include flange portions 48C that separate base portions 48A from spline portions 48B. Flange portions 48C provide a platform upon-which bumper ring 44 can rest, and provide a stop to control the distance base portions 48A can be inserted into bores 56. Radial pins 48 extend radially outward from LPT case 23E at regular intervals. In one embodiment, radial pins 48 are spaced approximately every 1.0 inch (approximately every 2.54 centimeters) about the circumference of LPT case 23E. Constructed as such, pins 48 and bores 58 assemble to form a radial spline that permits bumper ring 44 to have only one degree of freedom to movement. Specifically, spline portions 48B permit bumper ring 44 to translate radially from centerline CL, i.e. up or down along spline portions 48B. Backward or forward translation along centerline CL is prevented. Additionally, rotation of bumper ring 44 about LPT case 23E and engine centerline CL is prevented.

In the embodiment shown, crank arms 38 are connected with unison ring 40 at the outer diameter surface of unison ring 40. As such, unison ring 40 is suspended from crank arms 38 such that unison ring 40 is concentrically disposed about bumper ring 44. In other embodiments, however, crank arms 38 are connected to the inner diameter surface of unison ring 40. In either case, unison ring 40 is cantilevered over LPT case 23E. Specifically, unison ring 40 is cantilevered over pins 48 such that bumper ring 44 can be positioned between unison ring 40 and LPT case 23E. Unison ring 40 includes an inner diameter somewhat larger than the diameter comprising the outer ends of pins 48. Thus, LPT case 23E is permitted to thermally expand in the radial direction during operation of engine 10 without causing binding of pins 48 with unison ring 40. Unison ring 40 is therefore not directly supported by or tied to LPT case 23E. To prevent deformation of unison ring 40, bumper ring 44 and bumper shims 46 are provided between unison ring 40 and LPT case 23E.

Bumper ring 44 comprises an independent rigid structure against which unison ring 40 is supported to maintain the circularity of unison ring 40. As described above, bumper ring 44 floats upon pins 48 above LPT case 23E. Because of the inherent rigidity and circularity of bumper ring 44, bumper ring 44 is maintained some distance above LPT case 23E on pins 48. Additionally, space is provided between the outer circumferential surface of bumper ring 44 and unison ring 40 to allow for the extension of pins 48 from LPT case 23E through bumper ring 44. Bumper shims 46 are intermittently disposed about the inner circumferential surface of unison ring 40 between pins 48 to take up most or all of the remaining space between bumper ring 44 and unison ring 40. Bumper shims 46 are secured to unison ring 40 with threaded fasteners or pin connectors at bores 60 and 62 of bumper shim 46 and unison ring 40, respectively. As such, unison ring 40 is rigidly supported at regular intervals along its inner diameter by bumper shims 46 to prevent distortion.

At idle operation, bumper ring 44 is placed some distance x above flange portions 48C of pins 48. Likewise, the space between the distal tips of spline portions 48B and the inner surface of unison ring 40 would be maintained at approximately the same distance. The magnitude of distance x is approximately equal to the expected maximum increase in the radius of LPT case 23E as would occur at the highest temperature operation of engine 10. As such the LPT case 23E would grow toward bumper ring 44 during operation of engine 10, and the distal tips of pins 48 would grow toward unison ring 40. The magnitude of distance x would, however, need not be exactly equal to the expected increase in radius of LPT case 23E as bumper ring 44 and unison ring 40 would themselves undergo an expansion in radius during operation of engine 10. However, since bumper ring 44 would be slightly hotter, as it is slightly closer to LPT case 23E than unison ring 40, gap d can be sized to accommodate the difference. In one embodiment, gap d between bumper ring 44 and bumper shims 46 is maintained at approximately 0.010" (~0.0254 cm) during idling operation of engine 10. Thus, at idle, unison ring 40 would maintain its generally annular shape as it is suspended from crank arms 38. Bumper shims 46 would prevent unison ring 40 from distorting more than the magnitude of gap d during operation of engine 10 at idle. Likewise, the clearance provided by gap d would permit bumper shims 46 to slide along bumper ring 44 to permit unison ring 40 to rotate about engine centerline CL.

During a transient loading of engine 10, LPT case 23E heats up causing the magnitude of distance x to shrink, resulting in LPT case 23E growing toward bumper ring 44 and the distal tips of pins 48 growing toward unison ring 40. Bumper ring 44 also grows toward bumper shims 46 causing gap d to shrink. It is not necessary that a clearance gap be maintained between bumper ring 44 and flange portions 48C, as bumper ring 44 is not needed to move or slide against flange portions 48C. However, bumper ring 44 must not cause a constriction in LPT case 23E so as to interfere with flow of primary air $A_P$ or operation of blades 34. It is, however, necessary that bumper shims 46 be able to slide along bumper ring 44 as unison ring 40 is required to rotate about engine centerline CL. As indicated above, during a transient loading operation, the pitch of variable vanes 32 needs to be adjusted to alter the airflow through LPT 22. As such, actuator 42 acts upon unison ring 40 to adjust crank arms 38. Typically, the torque applied by actuator 42 is effectively applied to unison ring 40 at a single point such that the force tends to induce distortion or deformation into unison ring 40 that affects it roundness, which affects accurate and consistent pitch control of vanes 32. However, the position of bumper shims 46 between unison ring 40 and bumper ring 44 prevent unison ring 40 from losing its centricity or circularity, but also permit bumper shims 46 to slide along bumper ring 44 without binding. Radial growth variations from thermal expansion based on the range of temperatures experienced near LPT case 23E are compensated for by bumper ring 44 and variable vane actuation mechanism 11A. Accordingly, LPT case 23E, unison ring 40 and bumper ring 44 can all be made from the same material as variable vane actuation mechanism 11A, which permits LPT case 23E, bumper ring 44 and unison ring 40 to each expand at their own rate without causing binding of unison ring 40 against LPT case 23E. Typically, LPT case 23E, bumper ring 44 and unison ring 40 are comprised of an alloy having high temperature limitations and a high coefficient of thermal expansion, such as Inconnel 718 or another nickel-based alloy. However, because the temperatures outside LPT case 23E are lower than inside, in another embodiment of the invention, LPT case 23E is comprised of a nickel-based alloy, while bumper ring 44 and unison ring 40 are comprised of a high strength steel (HSS). HSS is generally stronger, cheaper and lighter than nickel alloys, thus permitting additional flexibility in the design of variable vane actuation mechanism 11A.

Figure 4:
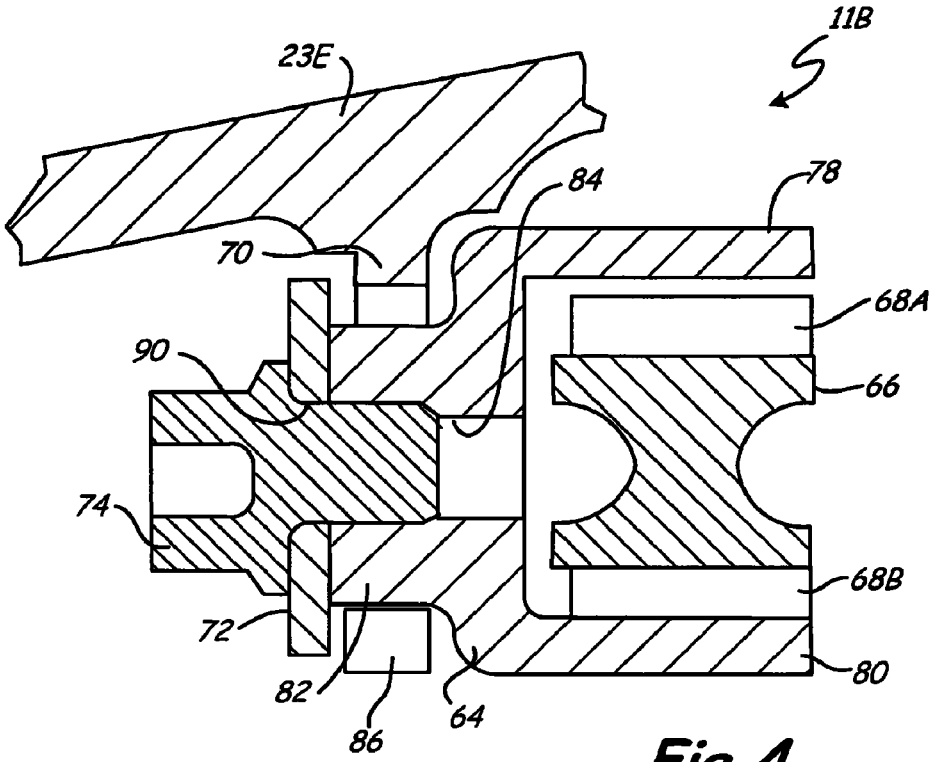
FIG. 4 shows an axial cross sectional view of a second embodiment of the variable vane actuation mechanism of the present invention in which a bumper ring is positioned inside of an engine casing.
Figure 5:
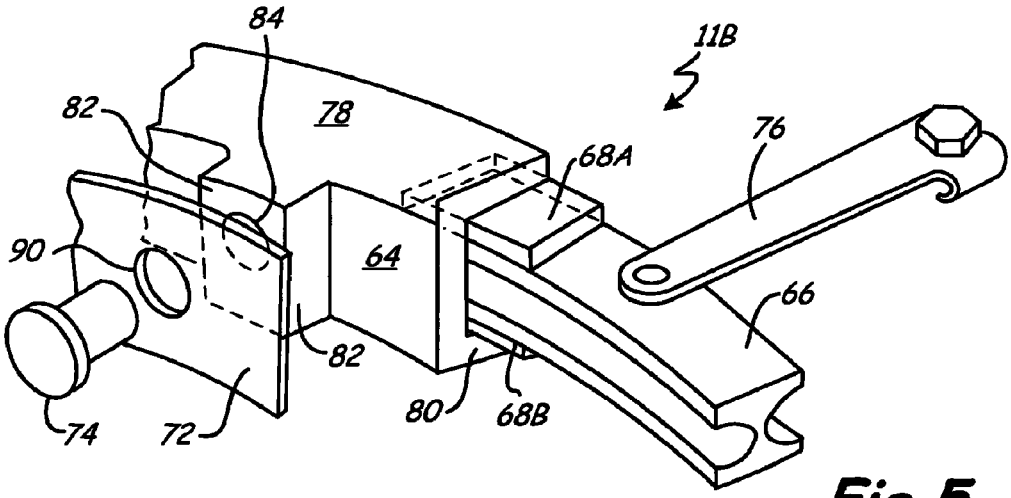
FIG. 5 shows a perspective view of the variable vane actuation mechanism of FIG. 4.

FIG. 4 shows an axial cross sectional view of a second embodiment of variable vane actuation mechanism 11B of the present invention in which bumper ring 64 is positioned radially inside of LPT case 23E. FIG. 5, which is discussed concurrently with FIG. 4, shows a perspective view of variable vane actuation mechanism 11B of FIG. 4. The use of variable vanes requires the use of additional actuation and synchronization hardware, which takes up space that is limited within an engine system or aircraft. As such it is desirable to position these components in an arrangement that is as compact as possible. For example, it would be desirable to include variable turbine vanes on sequential turbine blade stages, thus necessitating sequential actuation mechanisms and synchronization mechanisms. Variable vane actuation mechanism 11B of the present invention achieves a compact arrangement by positioning bumper ring 64 and other parts of actuation mechanism 11B within LPT case 23E, rather than assembling them outside and onto the exterior. With the interior embodiment of actuation mechanism 11B shown in FIGS. 4-6, and the exterior embodiment of actuation mechanism 11B shown in FIGS. 2-3, actuation mechanisms can be positioned alternately outside and inside of LPT case 23E to, among other things, save space.

In the interior embodiment, variable vane actuation mechanism 11B includes bumper ring 64, unison ring 66, bumper shims 68A and 68B, radial flange 70, washer plate 72, fastener 74 and crank arms 76. Additionally, in the interior embodiment, trunnions 50 of variable vanes 32 (FIG. 2) do not extend through LPT case 23E, but are contained within LPT case 23E and restrained by unison ring 66 and crank arms 76. Unison ring 66 is suspended radially outboard of rotor blades 34 by crank arms 76. Rotor blades 34 are sealed at their outer diameter by a separate sealing system (not shown). Crank arms 76 extend from the outer circumferential surface of unison ring 66 in a manner such that crank arms 76 can pivot on unison ring 66. Crank arms 76, however, join with the outer diameter ends of the trunnions of vanes 32 in a fixed manner such that crank arms 76 cause rotation of vanes 32. An actuator is mounted exterior of LPT case 23E and provided with access to crank arms 76 through an opening in LPT case 23E. Thus, a further benefit of actuation mechanism 11B is the reduction of the number of holes in LPT case 23E from the total needed for each variable vane to only one needed for the actuator. The actuator causes rotation of a master crank arm, causing unison ring 66 to rotate and pull crank arms 76. Actuation of unison ring 66, particularly during transient loading of engine 10, tends to induce deformation of unison ring 66, which crank arms 76 would not be able to completely prevent on their own. In one embodiment, unison ring 66 comprises an I-shaped cross section to increase its inherent stiffness. Bumper ring 64 is positioned adjacent unison ring 66 within LPT case 23E to inhibit deformation of the centricity of unison ring 66.

Bumper ring 64 comprises an annular body having a C-shaped cross-section forming an interior channel in which unison ring 66 is configured to be received. Bumper ring 64 includes outer bumper 78, inner bumper 80, lugs 82 and mounting bores 84. Bumpers 78 and 80 provide inner and outer support to unison ring 66 that prevent unison ring 66 from deforming. The interior channel of bumper ring 64 is larger than unison ring 66 is to permit attachment of crank arms 76. Bumper shims 68A and 68B are connected to unison ring 66 to take up the additional space between bumpers 78 and 80 and unison ring 66. Bumper shims 68A and 68B are intermittently placed around the inner and outer diameters of unison ring 66 to accommodate connection of crank arms 76 to unison ring 66. Bumper ring 66 also includes lugs 82, which comprises axially extending projections from bumper ring 66. In the embodiment shown, lugs 82 extend forward from the forward face of bumper ring 66. In one embodiment, bumper ring 64 includes approximately thirty to forty lugs 82. Lugs 82 comprise guadrangular bodies having side walls that extend generally radially, perpendicular to engine centerline CL, to engage with radial flange 70 of LPT case 23E.

Figure 6:
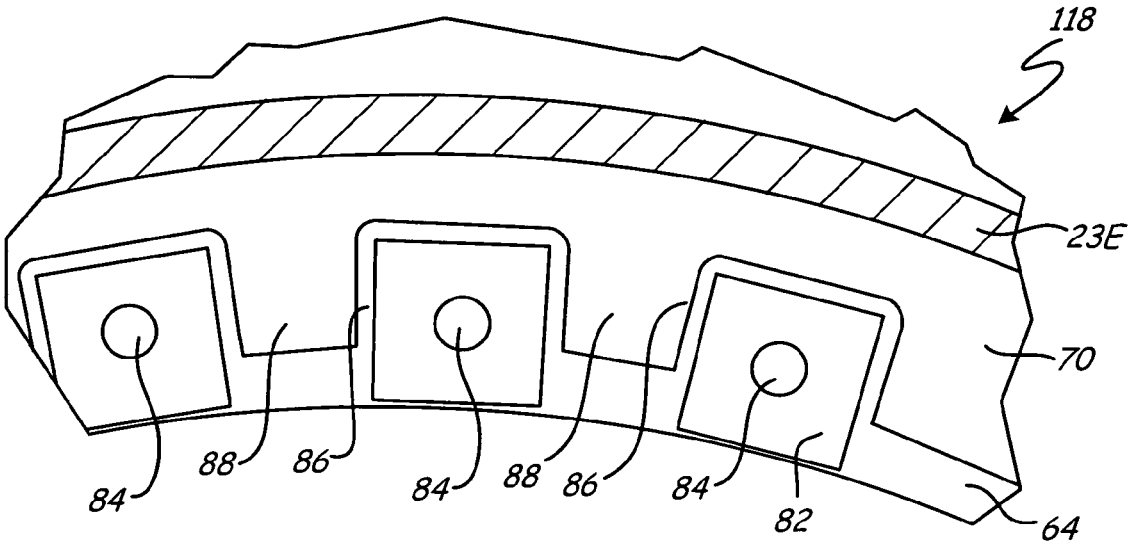
FIG. 6 shows a partial front view of the variable vane actuation mechanism of FIG. 4.

FIG. 6 shows a partial front view of radial flange 70 and lugs 82 of variable vane actuation mechanism 11B of FIG. 4. Radial flange 70 comprises an annular flange that extends radially inwardly from LPT case 23E. Flange 70 includes slots 86 that are intermittently cutout of flange 70 to form tabs 88. Tabs 88 extend generally radially from flange 70 such that the sidewalls of slots 86 engage the side walls of lugs 82. Tabs 88 extend radially inward from LPT case 23E at regular intervals to engage lugs 82. In one embodiment, tabs 88 are spaced approximately every 1.0 inch (approximately every 2.54 centimeters) about the interior of LPT case 23E. The specific height of lugs 82 and depth of slots 86 depends on design needs and the amount of radial thermal expansion that occurs within engine 10.

With reference to FIGS. 4 and 5, washer plate 72 is fastened to the forward surfaces of lugs 82 to restrain axial movement of bumper ring 64 along centerline CL. Washer plate comprises an annular ring that, in one embodiment, is split into two segments to facilitate assembly. Lugs 82 include holes 84 and washer plate 72 includes holes 90 that align to receive fasteners 74. Fasteners 74 are tightened onto lugs 82 to trap lugs 82 within slots 86, between bumper ring 64 and washer plate 72. As such, slots 86 and lugs 82 assemble to form a radial spline that permits bumper ring 64 to have only one degree of freedom to movement. Specifically, tabs 88 permit bumper ring 64 to translate radially from centerline CL, i.e. up or down along tabs 88. Backward or forward translation along centerline CL is prevented. Additionally, rotation of bumper ring 64 about engine centerline CL within LPT case 23E is prevented.

At idle operation of engine 10, bumper ring 64 comprises a rigid structure that, due to radial binding of lugs 82 within slots 86, rests within slots 86 such that space is provided between lugs 82 and the top of slots 86 on flange 70 of LPT case 23E. Thus, bumper ring 54 has space to thermally expand outward. Also at idle operation, unison ring 66 is disposed between bumpers 78 and 80 within bumper ring 64 such that unison ring 66 is supported at its inner and outer diameters. However, bumper shims 68A and 68B do not bind against bumpers 78 and 80, respectively, such that unison ring 66 is free to rotate about engine centerline CL within bumper ring 64.

During a transient loading of engine 10, unison ring 66 and bumper ring 64 are exposed to greater temperatures than LPT case 23E, as they are closer to the heat of primary air $A_P$ within LPT case 23E. As such, bumper ring 64 and unison ring 66 expand radially a greater amount than LPT case 23E. Bumper ring 64 expands to shrink the distance between the top surface of lugs 82 and the top of slots 86 in flange 70. Bumper ring 78 and unison ring 66 expand at a generally similar rate such that unison ring is still free to rotate within bumper ring 64, with bumper ring 64 still providing support to maintain the circularity of unison ring 66.

In one embodiment, unison ring 66 is disposed within bumper ring 66 at idle such that bumper shim 68A snuggly engages bumper 80, while a small clearance is provided between bumper shim 68A and bumper 78. In one embodiment, the gap between bumper 78 and bumper shim 68A is maintained at approximately 0.010" (~0.0254 cm) during idling operation of engine 10. At transient conditions, the gap shrinks such that bumper shim 68B disengages bumper 80 and bumper shim 68A engages bumper 78. However, the binding of bumper shim 68A on bumper 78 is prevented such that unison ring 66 is able to rotate within bumper ring 64. Thus, the interior embodiment of actuation mechanism 11B provides bumper ring 64 that provides inner and outer support to unison ring 66 from idle operation through a transient loading operation and back down to cooler operation. Thus, unison ring 66 is able to more accurately and consistently adjust the pitch of variable vanes 32 without undue binding from bumper ring 64 or LPT case 23E. In other embodiments of the invention, a bumper ring having a C-shaped cross section similar to bumper ring 64 could be used in an exterior embodiment of previously described actuation mechanism 11.

In one embodiment of the invention, LPT case 23E, bumper ring 64 and unison ring 66 are comprised of a nickel-based alloy such as Inconnel 718. In one embodiment of the invention, the surfaces of bumpers 78 and 80 facing the interior channel of bumper ring 64, and the surfaces of bumper shims 68A and 68B facing bumpers 78 and 80 are coated with a hardfacing material. In one embodiment, a sprayed-on Mg—Zr-Ox hardfacing compound is used, but any suitable hardfacing material as is known in the art may be used. The hardfacing material decreases the friction between bumper ring 64 and unison ring 66 to facilitate rotation of unison ring 66. Typically, bumper ring 64 is comprised of a nickel-based alloy, which has a tendency to act gummy at elevated temperatures such that friction between bumpers 78 and 80, and bumper shims 68A and 68B increases. The hardfacing also reduces wear of bumper ring 64, which reduces cost of actuation system 11B as the hardfacing can be easily removed and replaced at regularly scheduled maintenance overhauls.

The variable vane actuation mechanism of the present invention, in its various embodiments, provides an actuation mechanism that inhibits deformation of the circularity or centricity of a unison ring. In particular, the variable vane actuation mechanism includes a bumper ring that grows with the unison ring to keep the unison ring circular when acted upon by an actuator, while still permitting the unison ring to rotate when actuated. The bumper ring is connected to the engine casing through a radial spline that prevents axial and rotational displacement of the bumper ring, but allows the bumper ring to float a radial distance from the engine casing to engage the unison ring. Embodiments of the radial spline comprise various radial projections and cooperating radial receptacles, such as pin and bore connections (as used in variable vane actuation mechanism 11A), or lug and slot connections (as used in variable vane actuation mechanism 11B). However, in other embodiments, other such radial splines are acceptable. Radial splines provide low cost systems that are easy to machine and repair, permit the application of hardfacing and wear coatings, and provide systems that can be maintained at tight tolerances.

Although the present invention has been described with reference to preferred embodiments, workers skilled in the art will recognize that changes may be made in form and detail without departing from the spirit and scope of the invention.

The invention claimed is:

1. A variable vane actuation assembly for gas turbine engine having a turbine section with a plurality of rotatable stator vanes, the variable vane actuation assembly comprising:

an engine casing configured to encase the plurality of rotatable stator vanes;

a unison ring disposed concentrically with the engine casing;

a bumper ring disposed concentrically between the engine casing and the unison ring;

a radial spline connection extending from the engine casing and joining with the bumper ring, wherein the radial spline connection permits the bumper ring to float radially with respect to the engine casing, but prevents the bumper ring from rotating circumferentially with respect to the engine casing; and a plurality of bumper shims positioned between the unison ring and the bumper ring to limit deformation of the unison ring.

2. The variable vane actuation assembly of claim 1 wherein the radial spline connection comprises:

a flange extending radially from the engine casing;

radial slots extending into the flange; and lugs extending axially from the unison ring and configured to slide within the radial slots.

3. The variable vane actuation assembly of claim 2 wherein the radial spline connection further includes a washer plate connected to the lugs to prevent the bumper ring from axially disengaging the flange.

4. The variable vane actuation assembly of claim 3 wherein the flange extends radially inward from the engine casing.

5. The variable vane actuation assembly of claim 2 wherein the bumper ring comprises a C-shaped cross section having an inner bumper and an outer bumper and wherein the unison ring is positioned between the inner and outer bumpers.

6. The variable vane actuation assembly of claim 5 wherein the bumper shims are positioned on inner and outer surfaces of the unison ring to mate with the inner and outer bumpers of the bumper ring.

7. The variable vane actuation assembly of claim 6 and further comprising hardfacing applied to inner and outer surfaces of the plurality of bumper shims and the inner and outer bumpers of the bumper ring.

8. The variable vane actuation assembly of claim 1 wherein the radial spline connection comprises:

holes extending radially through the bumper ring; and pins extending radially from the engine casing and through the holes.

9. The variable vane actuation assembly of claim 8 wherein the pins extend radially outward from the engine casing.

10. The variable vane actuation assembly of claim 1 and further comprising a plurality of actuation arms extending from the unison ring to connect to outer diameter ends of the plurality of rotatable stator vanes.

11. The variable vane actuation assembly of claim 1 wherein there is a clearance between the plurality of bumper shims and the bumper ring of approximately 0.010 inches (approximately 0.0254 cm) at temperatures generated within the engine at idle operation.

12. A bumper assembly for a variable vane actuation mechanism, the bumper assembly comprising:

an annular engine casing configured to enshroud outer diameter ends of variable vanes;

projections extending radially from the engine casing to form an annular array;

a bumper ring comprising:

an annular body concentrically positioned with the annular array of projections; and receptacles for receiving the projections;

an annular unison ring comprising:

a first circumferential surface for engaging the bumper ring; and bores for connecting with actuation arms of the variable vanes; and bumper shims positioned on the first circumferential surface between the bores, and between the first circumferential surface and the bumper ring such that the bumper shims inhibit deformation of the unison ring.

13. The bumper assembly of claim 12 wherein:

the projections comprise a plurality of tabs arranged to form a plurality of slots between the tabs, wherein the tabs are formed from an annular flange extending radially from the engine case; and the bumper ring comprises:

a C-shaped annular bracket having an interior channel into which the unison ring is receivable; and a plurality of axial lugs positioned within the plurality of slots in the annular flange.

14. The bumper assembly of claim 13 wherein the annular flange extends radially inward from the engine case.

15. The bumper assembly of claim 12 wherein:

the projections comprise a plurality of pins extending from the engine case; and the receptacles comprise a plurality of holes in the annular body configured to receive the plurality of pins.

16. The bumper assembly of claim 15 wherein the plurality of pins extend radially outward from the engine case.

17. The bumper assembly of claim 12 and further comprising hardfacing applied to mating surfaces of the bumper shims and the bumper ring.

18. The bumper assembly of claim 12 wherein the projections are spaced approximately 1.0 inch (approximately 2.54 cm) apart along the circumference of the engine casing.

19. The bumper assembly of claim 12 wherein the unison ring, the bumper ring and the engine casing are all comprised of a nickel-based alloy.

20. A method for maintaining circularity of a unison ring in a variable vane assembly of a gas turbine engine, the method comprising the steps of:

forming a plurality of projections on an engine casing that extend in a radial direction;

positioning a bumper ring having a plurality of radial openings between the engine casing and the unison ring such that the plurality of projections engage the plurality of radial openings;

positioning a bumper shim between the unison ring and the bumper ring;

thermally deforming the engine casing, the unison ring and the bumper ring during operation of the gas turbine; and floating the bumper ring on the plurality of projections such that the bumper shim engages the unison ring to maintain circularity of the unison ring, and to prevent binding of the unison ring with the engine casing.

21. The method of claim 20 wherein the step of floating the bumper ring further comprises the steps of:

permitting radial expansion of the bumper ring along the plurality of projections; and preventing rotation of the bumper ring with respect to the engine casing with the plurality of projections.

22. The method of claim 20 wherein the thermally deforming comprises radial expansion and contraction.

* * * * *